United States Patent [19]

Platek

[11] 3,945,609

[45] Mar. 23, 1976

[54] DUAL ACTION CARPET STRETCHER

[76] Inventor: Stanley F. Platek, 187 Maplewood Ave., Maplewood, Essex County, N.J. 07040

[22] Filed: Jan. 13, 1975

[21] Appl. No.: 540,313

[52] U.S. Cl. ..... 254/60
[51] Int. Cl.[2] ..... A47G 27/04
[58] Field of Search ..... 254/60, 57, 58, 59, 61, 254/62, 63; 294/8.6

[56] References Cited

UNITED STATES PATENTS

| | | | |
|---|---|---|---|
| 537,164 | 4/1895 | Lindsay | 254/60 |
| 1,033,552 | 7/1912 | Dehlinger | 254/61 |
| 1,894,298 | 1/1933 | Sutton | 254/52 |
| 2,680,002 | 6/1954 | Farner | 254/60 |
| 3,199,838 | 8/1965 | Gillen | 254/60 |
| 3,374,023 | 3/1968 | Hill | 294/8.6 |

*Primary Examiner*—Al Lawrence Smith
*Assistant Examiner*—Robert C. Watson
*Attorney, Agent, or Firm*—Anthony F. Cuoco

[57] ABSTRACT

A device for stretching two segments of carpet for drawing said segments together to close a gap therebetween and for providing an apparently seamless carpet area. A pair of carpet grippers, each of which grips one of the carpet segments, are coupled through coupling means so as to be displaceable toward each other. A jack is arranged with the coupling means and is operator-actuated for displacing the grippers and stretching the segments toward each other until said segments are adjacent one another and the gap is closed.

8 Claims, 1 Drawing Figure

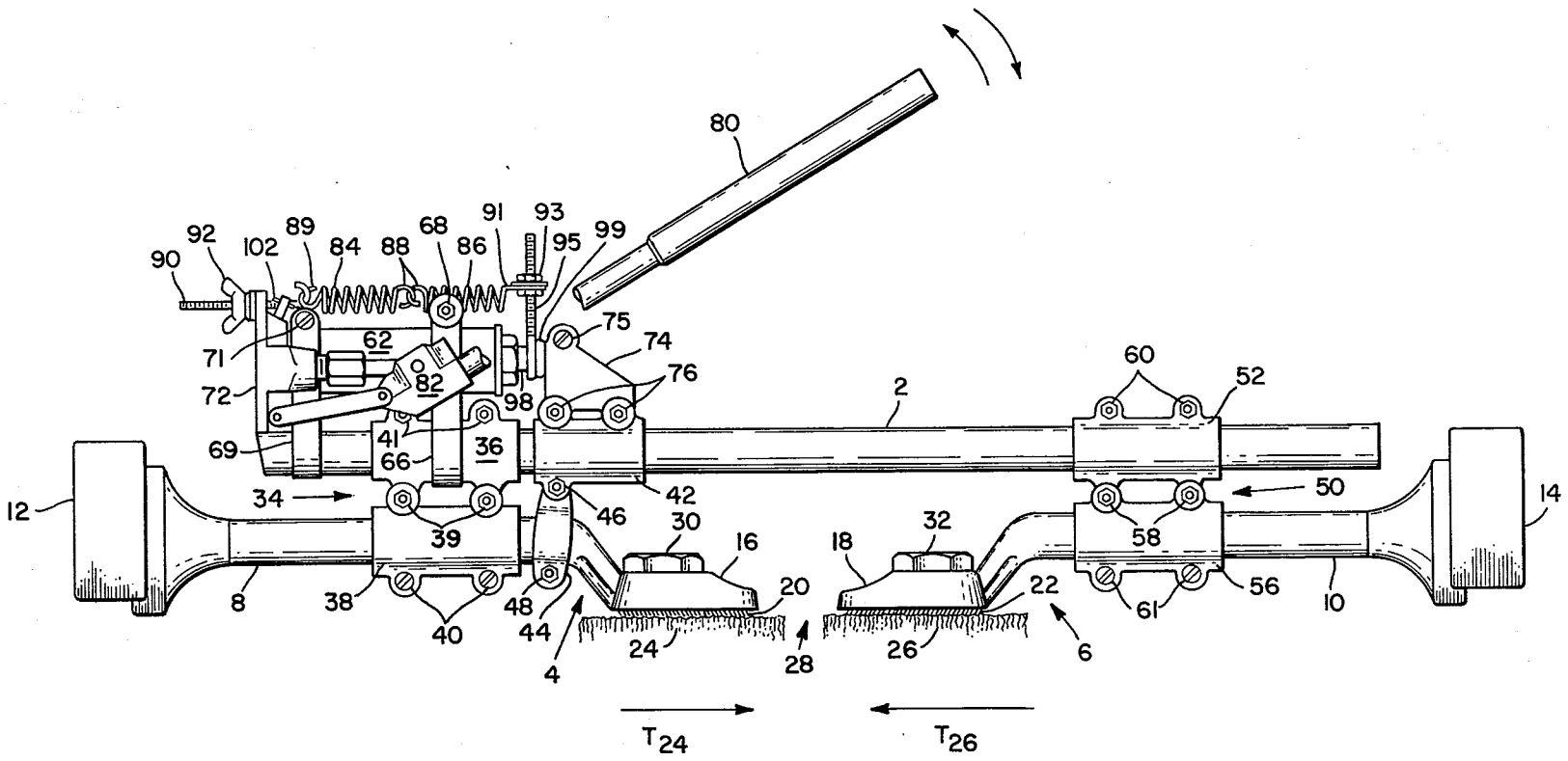
14
10
50
52
56
60
58
61
6
22
32
26
T26
2
18
28
20
16
80
42
30
24
T24
74
76
75
46
99
95
93
44
4
48
98
91
36
86
39
40
68
82
88
41
66
62
38
84
89
34
102
71
72
69
8
92
90
12

DUAL ACTION CARPET STRETCHER

BACKGROUND OF THE INVENTION

1. Field of the Invention

This invention relates generally to devices for closing gaps between carpet segments and, more particularly, to devices of the type described which are operator-actuated for stretching the carpet segments toward each other until they are adjacent for closing the gap therebetween, whereupon said segments may be secured for providing an apparently seamless carpet area.

2. Description of the Prior Art

Practitioners of the carpeting trades frequently face a situation wherein carpet segments of often different materials and unequal tautness must be drawn together to form an apparently seamless, continuous carpet area. This occurs when carpeting is initially installed such as in wall-to-wall fashion in a series of rooms, or when carpeting is cleaned by shampooing or steam cleaning methods, with the detergents and steam which are used causing the carpet segments to shrink away from one another where they have been previously stitched or cemented together. Likewise, carpeting patchwork may be required such as in cases where a segment of the carpet has been mutilated or otherwise destroyed and the necessity of providing an apparently seamless carpet area by joining several carpet segments is presented.

Prior art devices for accomplishing the aforenoted purposes may be such as described in U.S. Pat. 2,882,642 issued on Apr. 21, 1959 to Hill and U.S. Pat. No. 3,374,023 issued on Mar. 19, 1968 to Hill and Giandomenico, both of said patents being assigned to Roberts Associated Industries, Inc. These prior art devices grip only one carpet segment and require an operator applied stretching force to stretch the gripped segment toward the other for closing a gap that may exist therebetween. A disadvantage exists in that when only one carpet segment is stretched, splitting and tearing of the stretched segment is likely to occur due to the stretching force required before the segment ends are brought together to close the gap. In this connection it is to be noted that when carpet segments have shrunk due to the aforenoted cleaning, a high degree of force is necessary to bring the carpet segments together since the gap must be closed by stretching the existing carpet, as compared to an installation where excess carpet is most likely available.

SUMMARY OF THE INVENTION

The present invention overcomes the disadvantages of the prior art devices and contemplates a pair of carpet grippers, each of which grips a carpet segment and which grippers are coupled so as to be displaceable toward each other, and the coupling is operator-actuated by a jack type device whereby a force is exerted to displace the grippers to draw the segments together until the gap therebetween is closed. When the gap has been so closed the carpet segments may be held in place first by cementing and then by tacks, and which tacks may be removed when the cement has cured. The device of the invention is easier and safer to use and provides a higher degree of force and a more satisfactory result than that possible with the prior art devices.

One object of this invention is to provide an improved dual action carpet stretching device for use by practitioners of the carpeting trades.

Another object of this invention is to provide a dual action carpet stretcher whereby a pair of carpet segments are stretched toward each other to close a gap therebetween and to thereby eliminate excessive stretching of only one carpet segment toward the other which may cause splitting or tearing of the segment being stretched.

Another object of this invention is to provide a device of the type described including a pair of coupled carpet grippers and operatoractuated means for displacing the coupled grippers toward each other whereby a force is exerted by each of the grippers to provide a dual stretching action for stretching the carpet segments toward each other.

Another object of this invention is to provide a device of the type described which is particularly adaptable to stretching carpet segments which are unequally taut and which may be of different materials.

Another object of this invention is to provide a device of the type described which is safer and easier to operate and provides a greater stretching force than devices heretofore known in the art.

The foregoing and other objects and advantages of the invention will appear more fully hereinafter from a consideration of the detailed description which follows taken together with the accompanying drawing wherein a single and preferred embodiment of the invention is illustrated by way of example. It is to be expressly understood, however, that the drawing is for illustration purposes only and is not to be construed as defining the limits of the invention.

DESCRIPTION OF THE DRAWING

The single FIGURE in the drawing is a side view of a device according to the invention.

DESCRIPTION OF THE INVENTION

The device of the invention includes a main tubular support member designated by the numeral 2 and a pair of carpet grippers designated by the numerals 4 and 6. Grippers 4 and 6 may be, for purposes of illustration, of the type described in the aforenoted U.S. Pat. No. 2,882,642, and it will suffice to say for purposes of the present invention that the grippers include a pair of support arms 8 and 10 terminating in foam or rubber backed bumper pads 12 and 14, respectively, at one end, and terminating in carpet gripping heads 16 and 18 include gripping teeth 20 and 22, respectively, and which gripping teeth grip the piling of the carpet segments 24 and 26 separated by a gap designated by the numeral 28.

Gripping heads 16 and 18 include adjustable knobs 30 and 32, respectively, whereby the height of gripping teeth 20 and 22 may be adjusted for varying the gripping action exerted on carpet segments 24 and 26 as may be described depending on the depth of the carpet pile, the carpet texture and such other considerations as are necessary. When using the device of the invention, head 16 is placed on carpet segment 24 and head 18 is placed on carpet segment 26 near the ends of the segments so that the device of the invention spans gap 28 for purposes which will be hereinafter become evident. The operator, upon using the invention, may grasp member 2 between heads 16 and 18 to exert a downward force as may be desired.

A sleeve member 34 includes an upper sleeve 36 and a lower sleeve 38. The sleeves are substantially C-shaped and carry communicating extensions for supporting bolts 39 which affix the sleeves each to the other. Sleeve 38 surrounds arm 8 and is closed by drawing the ends of the sleeve together through bolts 40, while sleeve 36 surrounds member 2 and is closed by drawing the ends of the sleeve together through bolts 41. The arrangement is such that sleeve 36 grips tubular member 2, and arm 8 and sleeve 38 are in sliding relation.

A similar sleeve 42 surrounds member 2 and is disposed alongside sleeve 36. A clamp 44 is secured to sleeve 42 through a bolt 46 supported by communicating extensions of the sleeve and clamp. Clamp 44 is fastened around arm 8 through a bolt 48 carried at an opposite extension of the clamp to grip the arm. The arrangement is such that arm 2 and sleeve 42 are in sliding relation.

Likewise, a sleeve member 50 includes an upper sleeve 52 and a lower sleeve 56. Sleeves 52 and 56 carry extensions in communication with each other for supporting bolts 58 which affix the sleeves each to the other. Sleeve 52 surrounds member 2 and the sleeve is closed by drawing the ends of the sleeve together through bolts 60. Sleeve 56 surrounds arm 10 and the sleeve is closed by drawing the ends of the sleeve together through bolts 61. The arrangement is such that sleeve 56 grips arm 10 and sleeve 52 grips member 2.

In this connection it is to be noted that arms 8 and 10 may be removed from their respective sleeves 38 and 56 by removing bolts 40 and/or 61, as the case may be, to use grippers 4 and 6 in the manner described in the aforenoted U.S. Pat. No. 2,882,642.

A conventional type jack which may be, for purposes of illustration, a hydraulic jack designated by the numeral 62, may be secured to sleeve 36 through a clamp 66 and bolt 68, and secured to arm 2 through a clamp 69 and bolt 71. An end plate 72 may be suitably affixed to tubular member 2 as by welding or the like and an angle plate 74 may be secured to sleeve 42 by bolts 76 carried by communicating ends of the angle plate and sleeve. Angle plate 74 may carry a securing bolt 75 at an opposite end thereof. Bolts 76 further serve the purpose of drawing the ends of sleeve 42 together to close the sleeve. In this connection it is to be noted that the ends of sleeves 38 and 42 may carry spacers or washers (not shown) therebetween so that when bolts 39 and 76, respectively, are tightened to draw the sleeve ends together sufficient clearance exists between arm 8 and sleeve 38 and member 2 and sleeve 42 to provide the aforenoted sliding action.

A removable jack handle 80 is in engagement with a conventional type jack actuating linkage arrangement 82. Jack 62 is operated by operator pumping or displacement of handle 80 alternately in opposite directions as shown by the arrows in the drawing.

A spring arrangement including a spring 84 coupled to a spring 86 through spring loops 88 applies a restraining force for purposes which will be hereinafter explained. Spring 84 is secured at its end 89 to a threaded hook 90 secured to end plate 72 through a wing nut 92 for adjusting the spring tension as may be required. Spring 86 is secured at its end 91 through a clamp 93 in engagement with a threaded eye-rod 95 for vertical alignment of the spring as may be required. Rod 95 engages jack shaft 98 adjacent a shoulder 99 thereon.

OPERATION OF THE INVENTION

Upon the aforenoted operation of jack 62, shaft 98 moves out of the jack and pushes against angle plate 74 against the tension or force provided by springs 84 and 86. As heretofore noted, sleeves 36 and 52 grip tubular member 2, sleeve 56 grips arm 10, clamp 46 couples sleeve 42 to arm 8, tubular member 2 is in sliding relation with sleeve 42 and arm 8 is in sliding relation with sleeve 38. With this arrangement between the sleeves, arms, clamps, tubular member and angle plate, operation of jack 62 as heretofore described causes either gripping head 4 to 6 to move toward the other gripping head, or both gripping heads to move toward each other to stretch carpet segments 24 and 26 to close gap 28 as will be next described.

It will be assumed that carpet segments 24 and 26 are initially under unequal conditions of tension as indicated by the vectors $T_{24}$ and $T_{26}$ in the drawing. That is, carpet segment 24 may be affected by a lesser tensile force $T_{24}$ so as to be less taut than carpet segment 26. This may be due to a variety of reasons such as different carpet materials for the segments, carpet segment 24 having shrunk less during cleaning than carpet segment 26, carpet segment 24 having more material than carpet segment 26, and such other conditions as will be understood by those skilled in the art.

Upon the aforenoted operative action of jack 62, carpet segment 24 offers less resistance to the jack force than carpet segment 26, whereupon arm 8 slides in sleeve 38 to displace gripping head 16 rightwardly with reference to the figure so that carpet segment 24 is stretched toward carpet segment 26. It will be understood that if carpet segment 26 were initially less taut than carpet segment 24, carpet segment 26 would offer less resistance to the jack force, whereupon member 2 would slide in sleeve 42 to displace gripping head 18 leftwardly with reference to the figure so that carpet segment 26 would be stretched toward carpet segment 24.

If carpet segments 24 and 26 are initially equally as taut or become substantially so by first stretching one of the segments toward the other as aforenoted, then both segments offer equal resistance to the jack force and the operative action of the jack causes arm 8 to slide in sleeve 38 and member 2 to slide in sleeve 42, whereupon gripping heads 16 and 18 are displaced toward each other. Thus, the device of the invention closes gap 28 by first stretching the less taut carpet segment toward the other and then by stretching both of the carpet segments toward each other when the segments are equally as taut.

When carpet segments 24 and 26 coincide with each other, that is, when gap 28 is closed, the carpet segments may be held in place by first applying a glue or cement underneath the carpet segments for securing purposes and then by using carpet tacks which may be removed when the glue has suitably cured. Removal of the device of the invention from the carpet is achieved by releasing or opening hydraulic jack pressure valve 102, and which may be accomplished by providing a suitable wrench arrangement at the end of removable jack handle 80 or by a separate wrench as may be desired. Upon opening the pressure valve, jack shaft 18 moves back into jack 62 and away from angle plate 74 aided by the action of spring members 84 and 86, whereupon gripper heads 4 and 6 may be manually moved away from each other and the device of the invention may be lifted away and respositioned at another carpet area for further stretching or closing another gap as may be desired.

It will now be seen from the aforenoted description of the invention that a device of great utility in the carpet trades has been provided. In contrast to the prior art devices, a pair of carpet grippers are coupled so as to be displaceable toward each other upon actuation of the jack to stretch the carpet segments, whereby a gap between the segments is closed. The device requires no operator applied stretching force as do the prior art devices and is thus easier and safer to use. The invention overcomes the disadvantages of the prior art devices in that both carpet segments may be drawn toward each other so as to prevent tearing and splitting of the carpet as often occurs if only one of the segments is drawn toward the other segment, while providing a greater overall stretching force.

Although only one embodiment of the invention has been illustrated and described, various changes in the form and relative arrangement of the parts which will now appear obvious to those skilled in the art may be made without departing from the spirit and scope of the invention. For example, although the invention has been described as using a hydraulic jack, conventional mechanical or pneumatic jacks may be used as well. Likewise, various types of carpet grippers may be employed with the invention to achieve the purposes described. Further, although the spring arrangement described employs a pair of springs 84 and 86 as has been found to provide a wider spring force adjustment range, a single spring might be used as well.

What is claimed is:

1. Apparatus for stretching a pair of carpet segments for closing a gap between the segments, comprising:

a pair of carpet gripping members disposed so that each member grips a corresponding carpet segment:

means for coupling the carpet gripping members so that said members are displaceable toward each other and including a support member extending substantially parallel to the carpet segments, one of the pair of carpet gripping members having a first arm extending parallel to the support member near one end thereof and the other of the pair of carpet gripping members having a second arm extending parallel to the support member near the opposite end thereof, and each of the first and second arms supporting a gripping head for gripping a carpet segment, sleeve means disposed near the one end of the support member and including a first sleeve in sliding relation with the first arm near said one end and a second sleeve which grips the support member, a third sleeve disposed near the second sleeve in sliding relation with the support member and means for coupling the third sleeve to said arm, other sleeve means disposed near the opposite end of the support member and including a fourth sleeve which grips the second arm near said opposite end and a fifth sleeve which grips the support member, means for coupling the first and second sleeves together, and means for coupling the fourth and fifth sleeves together; and means arranged with the coupling means and operator-actuated for displacing the gripping member which grips a less taut segment of the pair of carpet segments for stretching said segment toward the other, and for displacing both gripping members when the segments gripped thereby are equally as taut for stretching said segments toward each other, with the gap between the segments being thereby closed.

2. Apparatus as described by claim 1, wherein the means arranged with the coupling means and operator-actuated for displacing a gripping member which grips a less taut segment of the pair of carpet segments for stretching said segments toward each other, and for displacing both gripping members when the segments gripped thereby are equally as taut for stretching said segments toward each other, with the gap between the segments being thereby closed, includes:

jack means supported by the support member and the second sleeve;

a first plate member coupled to the third sleeve;

said jack means including a shaft extending substantially parallel to the support member and disposed adjacent the first plate member, and axially displaced upon operator-actuation of the jack means for exerting a force on said plate member whereupon the gripping member gripping the less taut carpet segment is displaced and both gripping members are displaced when the carpet segments are equally as taut.

3. Apparatus as described by claim 2, including:

a second plate member supported near the one end of the support member;

the jack means disposed between the first and second plate members;

spring means;

means for coupling an end of the spring means to the second plate member;

means for coupling the other end of the spring means to the jack shaft adjacent the first plate member; and the force exerted by the jack shaft upon the first mentioned plate member being exerted in opposition to a force exerted by the spring means.

4. Apparatus as described by claim 3, wherein the means for coupling the one end of the spring means to the second plate member, includes:

an adjusting member having an end engaging the one end of the spring means and an opposite threaded end extending through the second plate means; and a nut in engagement with the threaded end of the adjusting member and operator-operable therewith for adjusting the force exerted by the spring means.

5. Apparatus as described by claim 3, wherein the means for coupling the other end of the spring means to the jack shaft adjacent the first mentioned plate member, includes:

an aligning member having an end engaging the jack shaft and an opposite threaded end;

clamping means in engagement with the threaded end and clamping the other end of the spring means to said aligning member; and said aligning clamping means operable with the threaded end of said member for aligning the spring means.

6. Apparatus as described by claim 3, wherein:

the spring means is disposed substantially parallel to the axis of the jack shaft.

7. Apparatus as described by claim 4, wherein:

the adjusting member is disposed substantially parallel to the axes of the spring means and jack shaft.

8. Apparatus as described by claim 5, wherein:

the aligning member is disposed substantially normal to the axes of the spring means and jack shaft.

* * * * *